US010805714B2

(12) United States Patent
Gomes et al.

(10) Patent No.: US 10,805,714 B2
(45) Date of Patent: Oct. 13, 2020

(54) ACTUATORS HAVING COMPLIANT MEMBER AND PANEL AUDIO LOUDSPEAKERS INCLUDING THE ACTUATORS

(71) Applicant: Google LLC, Mountain View, CA (US)

(72) Inventors: Rajiv Bernard Gomes, San Jose, CA (US); James East, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/289,269

(22) Filed: Feb. 28, 2019

(65) Prior Publication Data

US 2020/0280795 A1 Sep. 3, 2020

(51) Int. Cl.

| | |
|---|---|
| ***H04R 9/02*** | (2006.01) |
| ***H04R 1/10*** | (2006.01) |
| ***H04R 1/24*** | (2006.01) |
| ***H04R 7/04*** | (2006.01) |
| ***H04R 1/28*** | (2006.01) |
| ***H04R 9/06*** | (2006.01) |

(52) U.S. Cl.

CPC ..... *H04R 1/24* (2013.01); *H04R 1/1075* (2013.01); *H04R 1/2811* (2013.01); *H04R 7/04* (2013.01); *H04R 9/025* (2013.01); *H04R 9/06* (2013.01); *H04R 2400/03* (2013.01); *H04R 2400/11* (2013.01); *H04R 2499/11* (2013.01)

(58) Field of Classification Search

CPC ..... H04R 1/24; H04R 1/1075; H04R 1/2811; H04R 7/04; H04R 9/025; H04R 9/06; H04R 2400/03; H04R 2400/11; H04R 2499/11

See application file for complete search history.

(56) References Cited

U.S. PATENT DOCUMENTS

| | | | | |
|---|---|---|---|---|
| 6,390,232 | B1 * | 5/2002 | Kirschbaum | H04R 7/127 181/166 |
| 7,324,655 | B2 * | 1/2008 | Sato | B06B 1/045 381/151 |
| 9,294,841 | B2 | 3/2016 | Sahyoun | |
| 10,462,554 | B2 * | 10/2019 | Ham | G02B 6/0055 |

(Continued)

OTHER PUBLICATIONS

PCT International Search Report and Written Opinion in International Appln. No. PCT/US2019/063034, dated Feb. 13, 2020, 16 pages.

*Primary Examiner* — Brian Ensey
(74) *Attorney, Agent, or Firm* — Fish & Richardson P.C.

(57) ABSTRACT

A panel audio loudspeaker includes a panel extending in a plane. The loudspeaker also includes an actuator coupled to one side of the panel and configured to couple vibrations to the panel to cause the panel to emit audio waves. The actuator includes a rigid frame attached to a surface of the panel, the rigid frame includes a portion extending perpendicular to the panel surface and a plate extending parallel to the panel. The actuator also includes a magnet assembly and a magnetic coil forming a magnetic circuit. The actuator further includes at least one flexible member connecting the magnetic circuit to the portion of the rigid frame extending perpendicular to the panel surface. The actuator also includes a compliant member positioned between the magnetic circuit and the panel, the compliant member being configured to increase output of the loudspeaker compared to the actuator without the compliant member.

19 Claims, 8 Drawing Sheets

(56) References Cited

U.S. PATENT DOCUMENTS

| | | | | |
|---|---|---|---|---|
| 2003/0051940 | A1* | 3/2003 | Anthony | H04R 1/24<br>181/171 |
| 2006/0034467 | A1* | 2/2006 | Sleboda | H04R 5/02<br>381/86 |
| 2007/0291976 | A1* | 12/2007 | Kajiwara | H04R 11/02<br>381/400 |
| 2018/0343512 | A1* | 11/2018 | Choi | H04R 1/028 |

* cited by examiner

ACTUATORS HAVING COMPLIANT MEMBER AND PANEL AUDIO LOUDSPEAKERS INCLUDING THE ACTUATORS

BACKGROUND

This specification relates to actuators that include one or more compliant members and to panel audio loudspeakers that feature the actuators.

Many conventional loudspeakers produce sound by inducing piston-like motion in a diaphragm. Panel audio loudspeakers, in contrast, operate by inducing distributed vibration modes in a panel through an electro-acoustic actuator. Typically, the actuators are electromagnetic or piezoelectric actuators.

SUMMARY

Disclosed are panel audio loudspeakers featuring an actuator attached to an acoustic radiator (e.g., a display panel). The loudspeakers include a compliant member that can improve the high frequency performance of the system. The shape and relative position of the compliant member to other components of the mass-spring system can be changed to accommodate size constraints of the actuator. In addition, the material properties of the compliant member can be changed to affect the resonance frequency of the corresponding actuator.

In general, in a first aspect, the invention features a panel audio loudspeaker, that includes a panel extending in a plane. The panel audio loudspeaker also includes an actuator coupled to one side of the panel and configured to couple vibrations to the panel to cause the panel to emit audio waves. The actuator includes a rigid frame attached to a surface of the panel, the rigid frame includes a portion extending perpendicular to the panel surface and a plate extending parallel to the panel. The actuator also includes a magnet assembly and a magnetic coil forming a magnetic circuit. The actuator further includes at least one flexible member connecting the magnetic circuit to the portion of the rigid frame extending perpendicular to the panel surface. The actuator also includes a compliant member positioned between the magnetic circuit and the panel, the compliant member being configured to improve a response of the panel audio loudspeaker for at least some frequencies from 5 kHz to 20 kHz compared to the actuator without the compliant member.

Implementations of the panel audio loudspeaker can include one or more of the following features and/or one or more features of other aspects. For example, the compliant member can be positioned between the magnetic circuit and the plate. The compliant member can be positioned between the magnetic coil and the plate, the compliant member mechanically coupling the magnetic coil to the plate.

In other implementations, the compliant member is positioned between the panel and the plate. The compliant member can be substantially coextensive with the panel.

In yet other implementations, the response of the panel audio loudspeaker is at least 5 dB higher for at least some frequencies from 7.5 kHz to 20 kHz compared to the actuator without the compliant member.

In some implementations, the compliant member includes a foam, while in other implementations, the compliant member includes an elastomer. In yet other implementations, the compliant member includes a pressure sensitive adhesive. In other implementations, the compliant member includes a material having a Shore A hardness in a range from 20 to 90.

In some implementations, the magnetic coil is rigidly attached to the plate.

In other implementations the panel includes a display panel.

In another aspect, the invention features a mobile device or a wearable device that includes an electronic display panel extending in a plane. The mobile device or wearable device also includes a chassis attached to the electronic display panel and defining a first space between a back panel of the chassis and the electronic display panel. The mobile device or wearable device further includes an electronic control module housed in the first space. The electronic control module also includes a processor. The mobile device or wearable device further includes a back plate facing the electronic display panel, the electronic display panel and the back plate defining a second space therebetween. The mobile device or wearable device also includes an actuator housed in the second space and attached to a surface of the electronic display panel, the actuator and electronic display panel forming a panel audio loudspeaker. The actuator includes a rigid frame attached to a surface of the electronic display panel, the rigid frame including a portion extending perpendicular to the electronic display panel surface and a plate extending parallel to the electronic display panel. The actuator includes a magnet assembly and a magnetic coil forming a magnetic circuit. The actuator further include at least one flexible member connecting the magnetic circuit to the portion of the rigid frame extending perpendicular to the electronic display panel surface. The actuator also includes a compliant member positioned between the magnetic circuit and the electronic display panel, the compliant member being configured to improve a response of the panel audio loudspeaker for at least some frequencies from 5 kHz to 20 kHz compared to the actuator without the compliant member. The electronic control module is in electrical communication with the actuator and programmed to activate the actuator during operation of the mobile device or wearable device to cause the vibration of the electronic display panel.

In some implementations, the mobile device is a mobile phone or a tablet computer. In some implementations, the wearable device is a smart watch or a head-mounted display.

Among other advantages, embodiments can feature panel audio loudspeakers with boosted output (e.g., 5 dB or more) at certain frequencies (e.g., high audio frequencies) compared to similar panel audio loudspeakers that don't include a compliant member. Additionally, the inclusion of a compliant member to a system can increase the performance of a panel audio loudspeaker without significantly affecting the size, manufacturing constraints, or material costs of the actuator.

Other advantages will be evident from the description, drawings, and claims.

BRIEF DESCRIPTION OF THE DRAWINGS

Like reference symbols in the various drawings indicate like elements.

DETAILED DESCRIPTION

Figure 1:
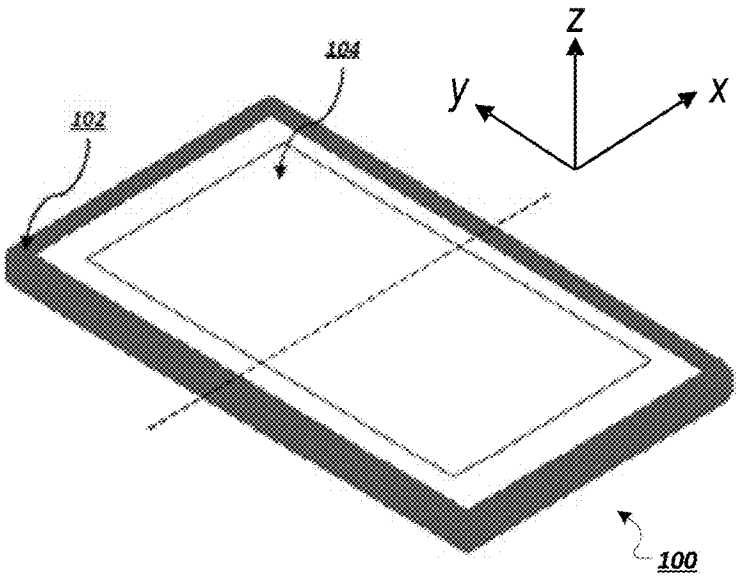
FIG. 1 (PRIOR ART)
FIG. 1 is a perspective view of an embodiment of a mobile device.

The disclosure features actuators for panel audio loudspeakers, such as distributed mode loudspeakers (DMLs). Such loudspeakers can be integrated into a mobile device, such as a mobile phone. For example, referring to FIG. 1, a mobile device 100 includes a device chassis 102 and a touch panel display 104, or simply panel 104, including a flat panel display (e.g., an OLED or LCD display panel) that integrates a panel audio loudspeaker. Mobile device 100 interfaces with a user in a variety of ways, including by displaying images and receiving touch input via panel 104. Typically, a mobile device has a depth (in the z-direction) of approximately 10 mm or less, a width (in the x-direction) of 60 mm to 80 mm (e.g., 68 mm to 72 mm), and a height (in the y-direction) of 100 mm to 160 mm (e.g., 138 mm to 144 mm).

Mobile device 100 also produces audio output. The audio output is generated using a panel audio loudspeaker that creates sound by causing the flat panel display to vibrate. The display panel is coupled to an actuator, such as a distributed mode actuator, or DMA. The actuator is a movable component arranged to provide a force to a panel, such as panel 104, causing the panel to vibrate. The vibrating panel generates human-audible sound waves, e.g., in the range of 20 Hz to 20 kHz. Generally, the efficiency of the actuator to produce audible sound waves varies as a function of frequency depending on the properties of the actuator, the panel, and the coupling of the actuator to the panel. Typically, the actuator/panel system will exhibit one or more resonant frequencies representing frequencies at which the sound pressure level as a function of frequency has a local maximum. It is generally desirable, however, for a panel audio loudspeaker to maintain a relatively high sound pressure level across the entire audio frequency spectrum.

In addition to producing sound output, mobile device 100 can also produces haptic output using the actuator. For example, the haptic output can correspond to vibrations in the range of 180 Hz to 300 Hz.

Figure 2:
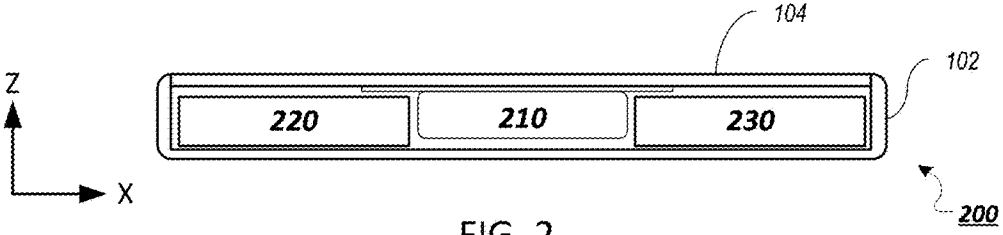
FIG. 2 (PRIOR ART)
FIG. 2 is a schematic cross-sectional view of the mobile device of FIG. 1.

FIG. 1 also shows a dashed line that corresponds to the cross-sectional direction shown in FIG. 2. Referring to FIG. 2, a cross-section 200 of mobile device 100 illustrates device chassis 102 and panel 104. FIG. 2 also includes a Cartesian coordinate system with x, y, and z axes, for ease of reference. Device chassis 102 has a depth measured along the z-direction and a width measured along the x-direction. Device chassis 102 also has a back plate, which is formed by the portion of device chassis 102 that extends primarily in the xy-plane. Mobile device 100 includes an actuator 210, which is housed in a space defined by panel 104 and the back plate of chassis 102. More specifically, actuator 210 is positioned behind panel 104 in chassis 102 and affixed to the back side of the panel. Generally, actuator 210 is sized to fit within a volume constrained by other components housed in chassis 102, including an electronic control module 220 and a battery 230.

The coupling between at least part of the actuator and the panel—and hence the frequency response of the system—can be tuned by inclusion of a compliant material in the system at appropriate locations. For example, referring to FIG. 3, an electromagnetic actuator 310 includes a compliant member 324 positioned between a magnetic coil 314 and a base plate 326 which is attached (e.g., adhesively bonded) to the back of panel 104. Actuator 310 also includes a frame 312, which includes two side walls that extend primarily in the z-direction perpendicular to base plate 326 and a pair of flexible members 316*a* and 316*b* that support a magnet assembly over magnetic coil 314. The magnet assembly includes a magnetic cup 318 that encloses a spacer 320 and a pole magnet 322 attached to the spacer. Pole magnet 322 can be circular in the xy-plane and generate a radial magnetic field perpendicular to the z-axis. Magnetic cup 318, spacer 320, and pole magnet 322 are shaped so that there is an air gap between the walls of the magnetic cup and the pole magnet. This air gap accommodates magnetic coil 314 and provides space for relative motion between the coil and magnetic cup 318.

During the operation of the actuator, electronic control module 220 energizes magnetic coil 314, such that a current passes through the coil. The current induces a magnetic field perpendicular to the magnetic field of pole magnet 322. Typically, the direction of the magnetic field to be in the x-direction so that the field is perpendicular to the flow of current. A magnetic field that surrounds coil 314 is induced by the current. Coil 314 experiences a force exerted by the magnetic field of the magnet assembly as a result of the placement of coil 314 in the magnetic field. As a result of the induced magnetic field, magnet assembly is displaced in the z-direction. Alternating the direction of the current causes the magnet assembly to vibrate back and forth in the z-direction exerting a force on panel 104, which also vibrates in the z-direction generating sounds waves.

Compliant member 324 is a spring element (e.g., a helical spring, a leaf spring, or a conical spring) that couples magnetic coil 314 to base plate 326 having a stiffness selected to tune the frequency response of the panel audio loudspeaker formed from the actuator and panel. More generally, compliant member 324 can be formed from any material or combination of materials that have mechanical properties sufficient to modify the frequency response of the panel audio loudspeaker (relative to rigidly coupling the magnetic coil to the base plate) to produce an enhanced response within a certain range of frequencies (e.g., at high frequencies) without significantly degrading the response at other frequencies. Generally, compliant member 324 can be formed from a metal, a plastic, a foam, an elastomer, or a pressure sensitive adhesive. In some embodiments, the compliant member can be formed from a material having a Shore A hardness in a range from 20 to 90 (e.g., 25 or more, 30 or more, 35 or more, 40 or more, 45 or more, e.g., 85 or less, 80 or less, 75 or less, 70 or less, 65 or less). In addition, the compliant member should be sufficiently resilient so that it does not deform or fatigue as a result of its interaction with the other components of the actuator. Generally, the size and shape of compliant member 324 can vary. Generally, it can be desirable to keep the compliant member as small as possible in order to avoid increasing the size of the actuator. In some embodiments, the compliant member can be shaped to have the same footprint (i.e., shape in the xy-plane) as the magnetic coil (e.g., circular). In some cases, the compliant member can extend beyond the magnetic coil. For example, the compliant member can be coextensive with the base plate. In yet other implementations, the compliant member can extend along the dimensions of panel 104.

In general, the size, shape, and material properties of the compliant member are chosen based on the desired frequency response of the system. For example, in some embodiments, the compliant member is selected to provide an increased frequency response at high audio frequencies without significantly degrading the response at lower frequencies. For example, compliant members can produce an increase in sound pressure level of 4 dB or more (e.g., 5 dB or more, 6 dB or more) for at least some frequencies above 7 kHz (e.g., from about 7 kHz to about 15 kHz) relative to comparable systems without a compliant member.

Figure 3:
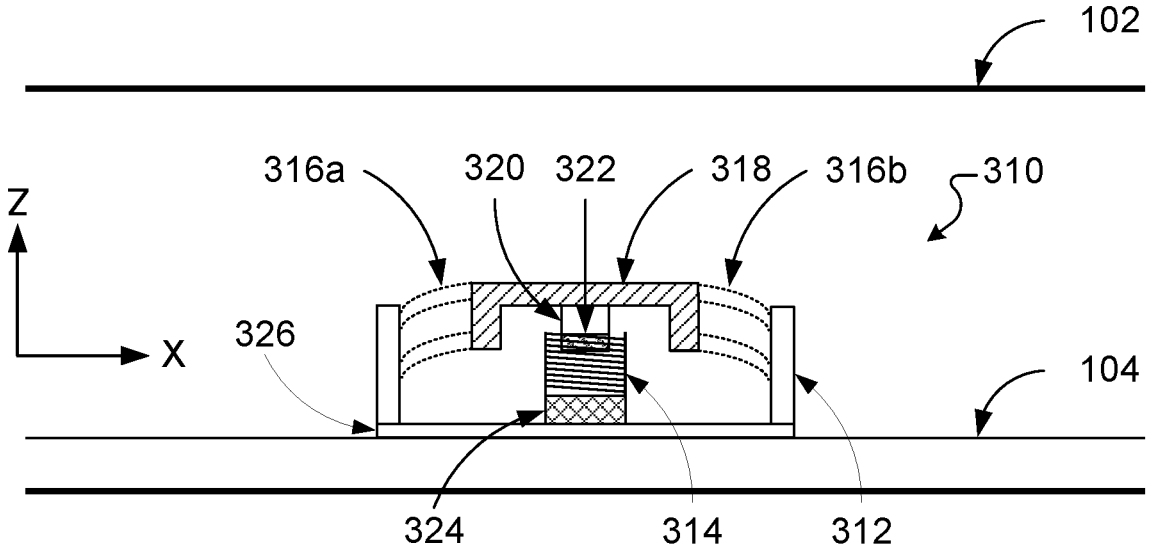
FIG. 3 is a schematic cross-sectional view of a portion of a mobile device showing an actuator that includes a compliant member attached between a base plate and a magnetic coil of the actuator.
Figure 4A:
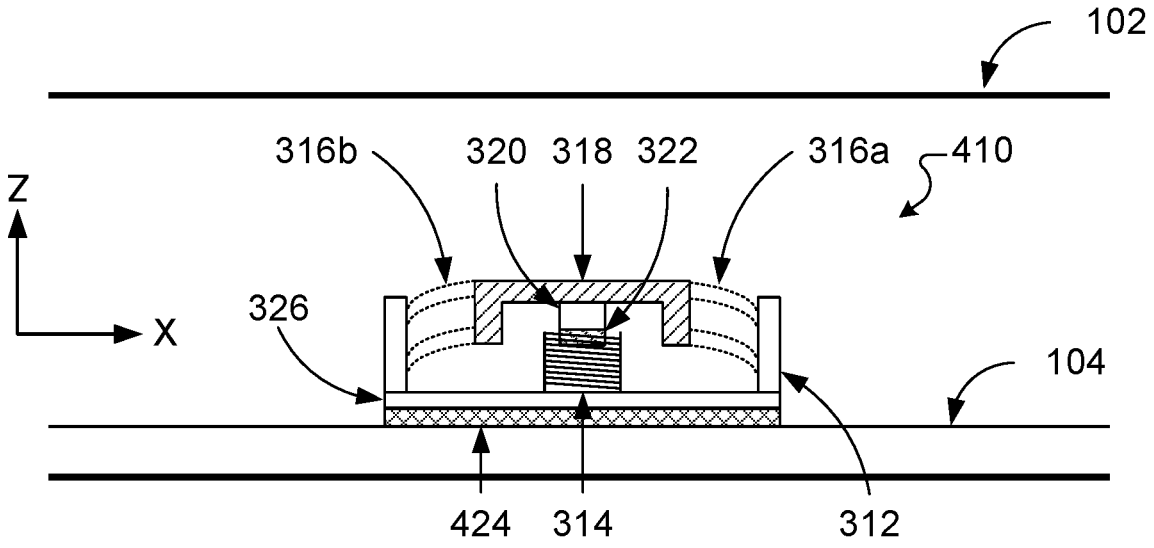
FIG. 4A is a side view of a portion of a mobile device showing an actuator that includes a compliant member attached between a base plate of the actuator and a panel of the mobile device.
Figure 4B:
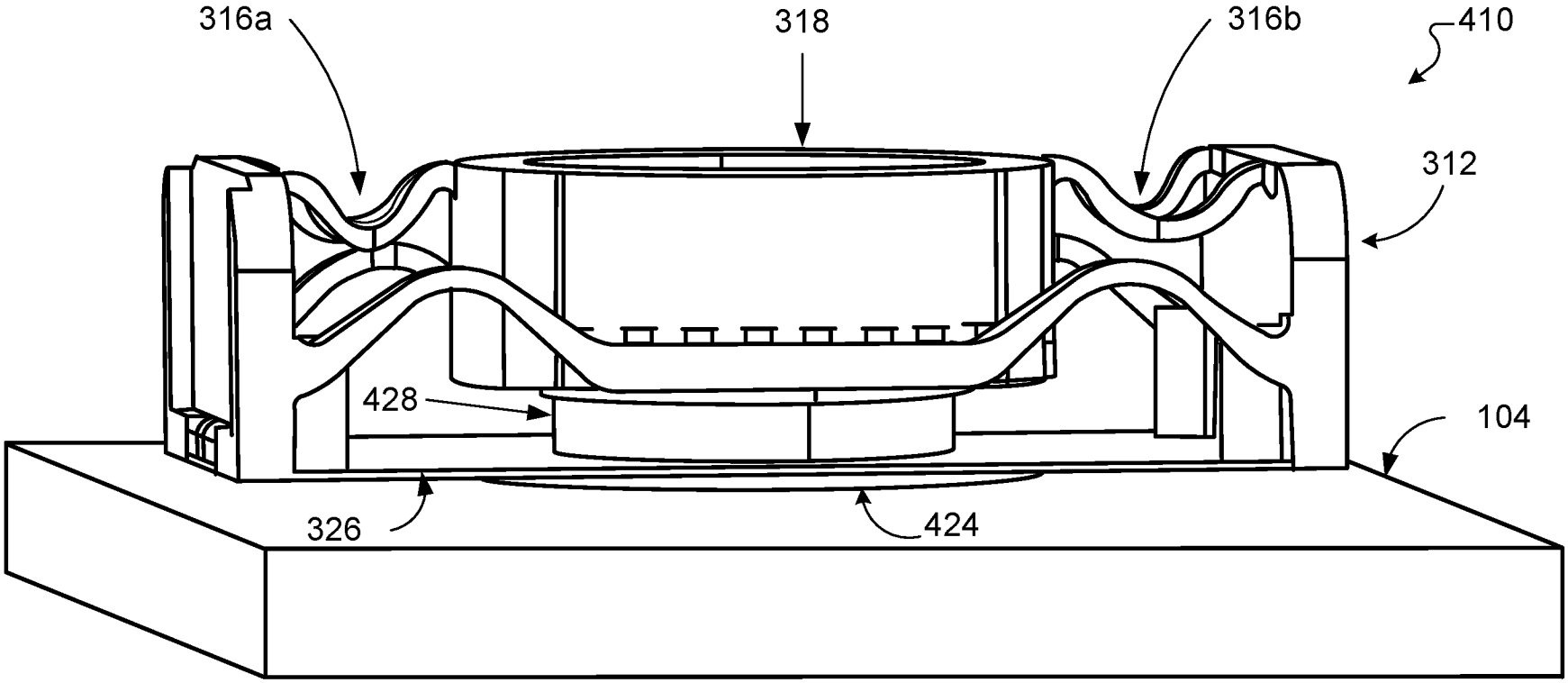
FIG. 4B is a schematic cross-sectional view of the mobile device and actuator of FIG. 4A.

While FIG. 3 shows an actuator 310 that includes compliant member 324 positioned between magnetic coil 314 and base plate 326, other arrangements are possible. For example, in some embodiments, the compliant member can be positioned between the base plate of the actuator and the panel of the mobile device. FIGS. 4A and 4B shows an example of such a system. Specifically, FIGS. 4A and 4B shows an actuator 410 having a base plate 326 that is bonded to a compliant member 424, which in turn is bonded to panel 104. Compliant member 424 is coextensive with base plate 326 and serves to modify the coupling of vibrations from actuator 410 to panel 104. FIG. 4B also includes a coil former or bobbin 428, which is a housing for coil 314. Therefore, while FIG. 4A shows coil 314, with regard to FIG. 4B, the coil is hidden from view by coil former 428. While FIG. 4A shows an implementation in which compliant member 424 is coextensive with base plate 326, in some implementations, the compliant member only extends part of the dimensions of the base plate.

Figure 5:
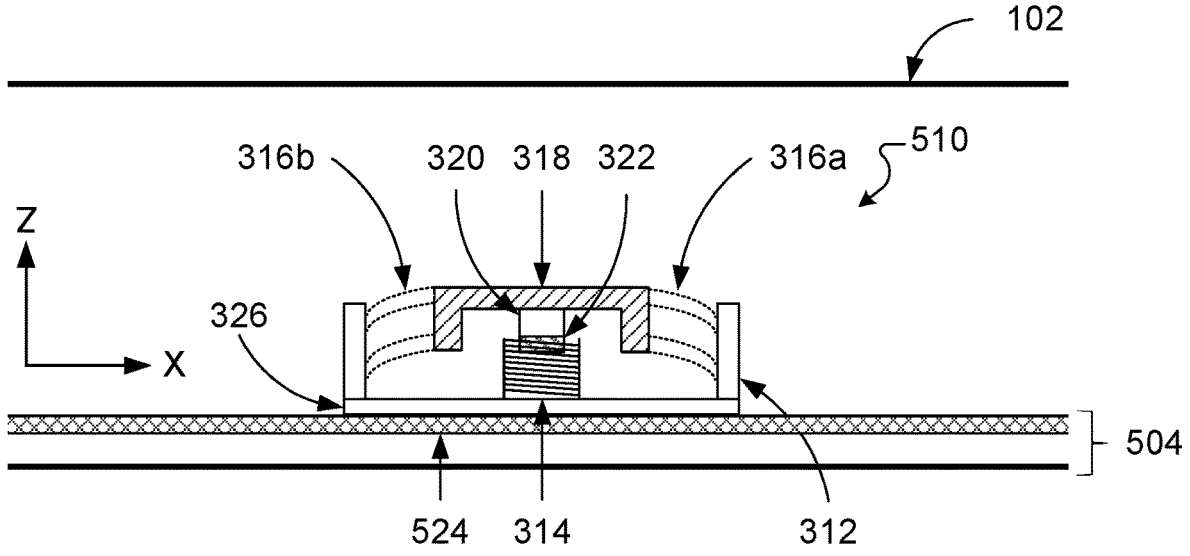
FIG. 5 is a cross-sectional view of a mobile device showing an actuator that includes the base plate of FIGS. 3, 4A, and 4B, which is attached to a panel that includes a compliant member.

Still other arrangements are possible. For example, while compliant member 424 is coextensive with base plate 326, FIG. 5 shows an actuator 510 attached to a panel 504 by a compliant member 524 that is coextensive with panel 504. For example, the compliant member can be applied (e.g., laminated) to the back of the panel, e.g., by the panel supplier and a generic actuator later applied to the panel. This may be advantageous where actuators are sourced from multiple different suppliers and/or actuator designs that do not integrate compliant members are used. Another advantage afforded by a panel having an integrated compliant member is that the combination of the panel, compliant member, and actuator can take up less space (e.g., as measured in the z-direction) when compared to a mobile device that includes a panel not having an integrated compliant member.

Figure 6:
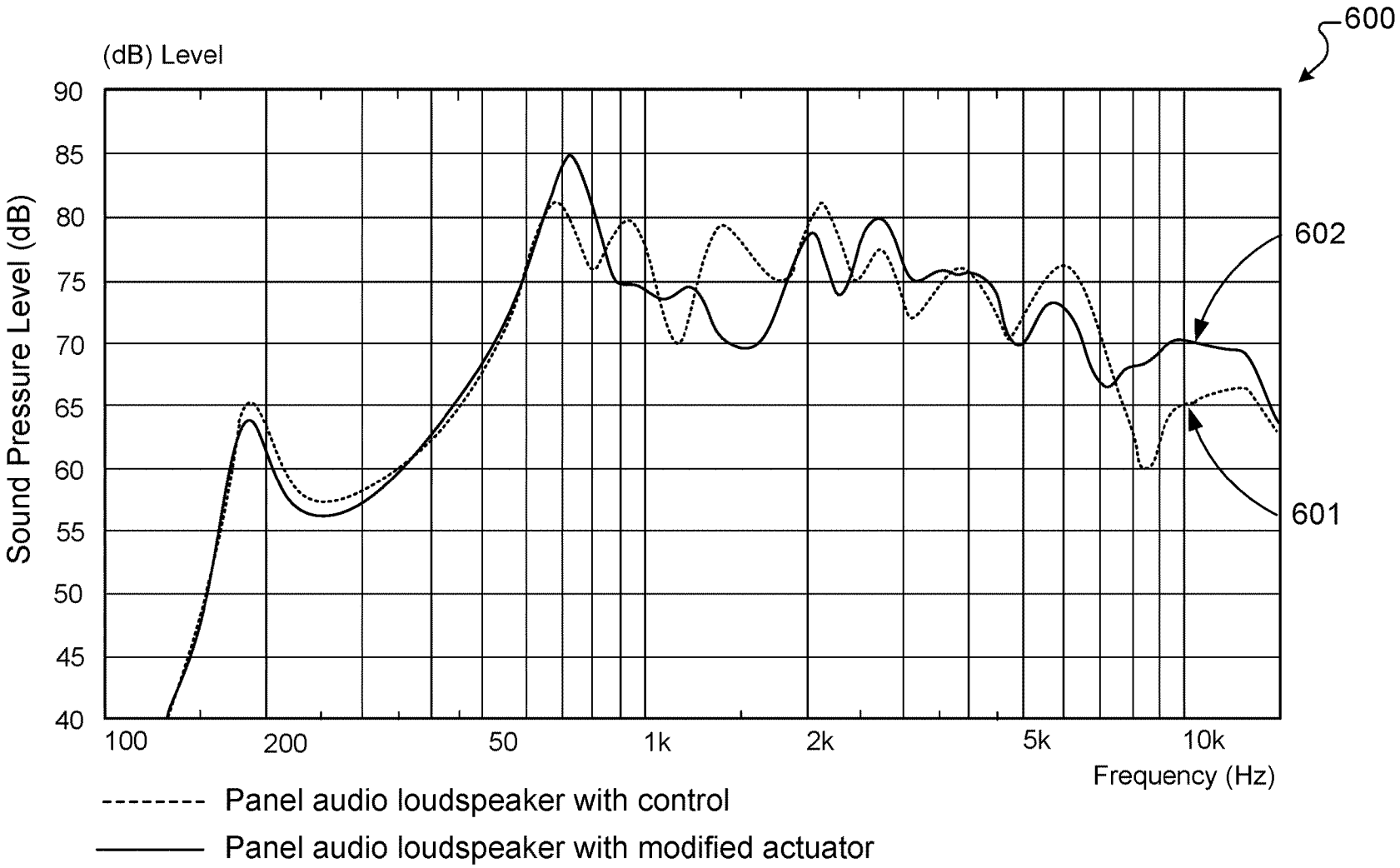
FIG. 6 is a plot that shows sound pressure level versus frequency for a panel audio loudspeaker having a control actuator and for a panel audio loudspeaker having a modified actuator.

Turning now to an example of the effect of a compliant member on the frequency response of a panel audio loudspeaker, FIG. 6 shows a plot 600 of sound pressure level, measured in dB, versus frequency, measured in Hz, for two panel audio loudspeakers. A first curve 601 corresponds to the frequency response of a panel audio loudspeaker featuring a control actuator that does not include a compliant member. A second curve 602 corresponds to the frequency response of a panel audio loudspeaker featuring a modified actuator that includes a compliant member positioned between a coil and a back panel, as described with regard to FIGS. 3A and 3B. Plot 600 shows certain frequencies at which the modified actuator provides a greater output than the control actuator. Specifically, for frequencies from approximately 7.5 kHz to just below 20 kHz, the panel audio loudspeaker featuring the modified actuator outputs a sound pressure level approximately 6 dB greater than the panel audio loudspeaker featuring the control actuator.

Figure 7:
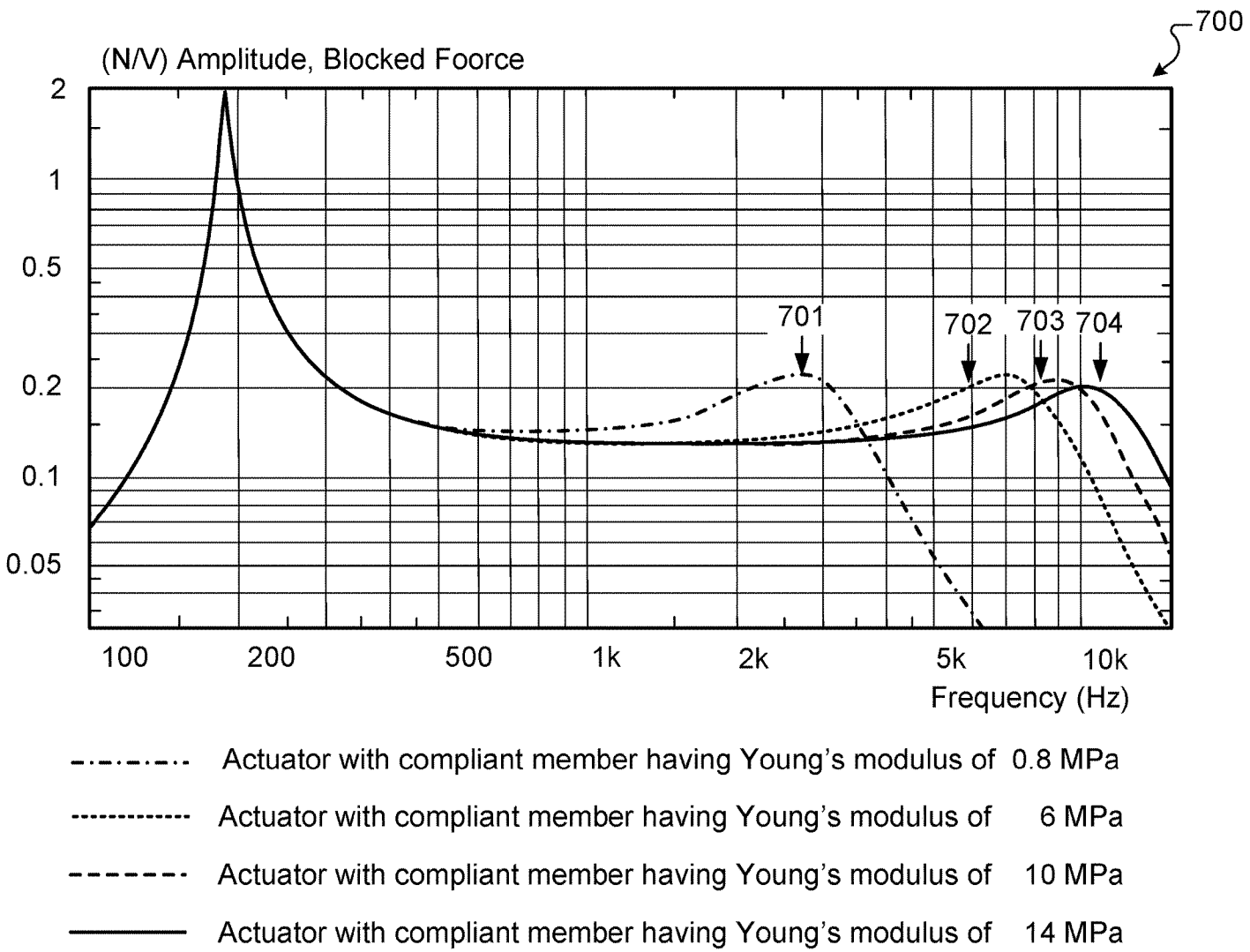
FIG. 7 is a plot that shows blocked force amplitude provided by an actuator versus frequency of the actuator for actuators that include a compliant member each having a different Young's modulus.

As discussed above, the material properties of the compliant member contribute to the power transfer of an actuator to panel 104. For example, FIG. 7 shows a plot 700 of blocked force amplitude provided by an actuator, measured in N/V, versus frequency of the actuator, measured in Hz. The blocked force amplitude is the maximum force generated by an actuator for a particular driving voltage. Plot 700 shows four curves, each corresponding to an actuator that includes a compliant member having a different Young's modulus. Curves 701 through 704 correspond to actuators with compliant members having Young's moduli of 0.8 MPa, 6 MPa, 10 MPa, and 14 MPa, respectively. The compliant member of the actuator is a ring-shaped elastic material. Plot 700 shows a peak frequency at approximately 175 Hz for each of the actuators.

The peak frequency corresponds to the first resonance frequency of the actuator. The local peaks at higher frequencies correspond to the second resonance frequencies of the actuators. Plot 700 shows that varying the Young's modulus of the compliant member results in each actuator exhibiting a different second resonance frequency. Furthermore, plot 700 shows that as Young's modulus of a compliant member increases, so too does the frequency of the second resonance of the corresponding actuator.

Figure 8:
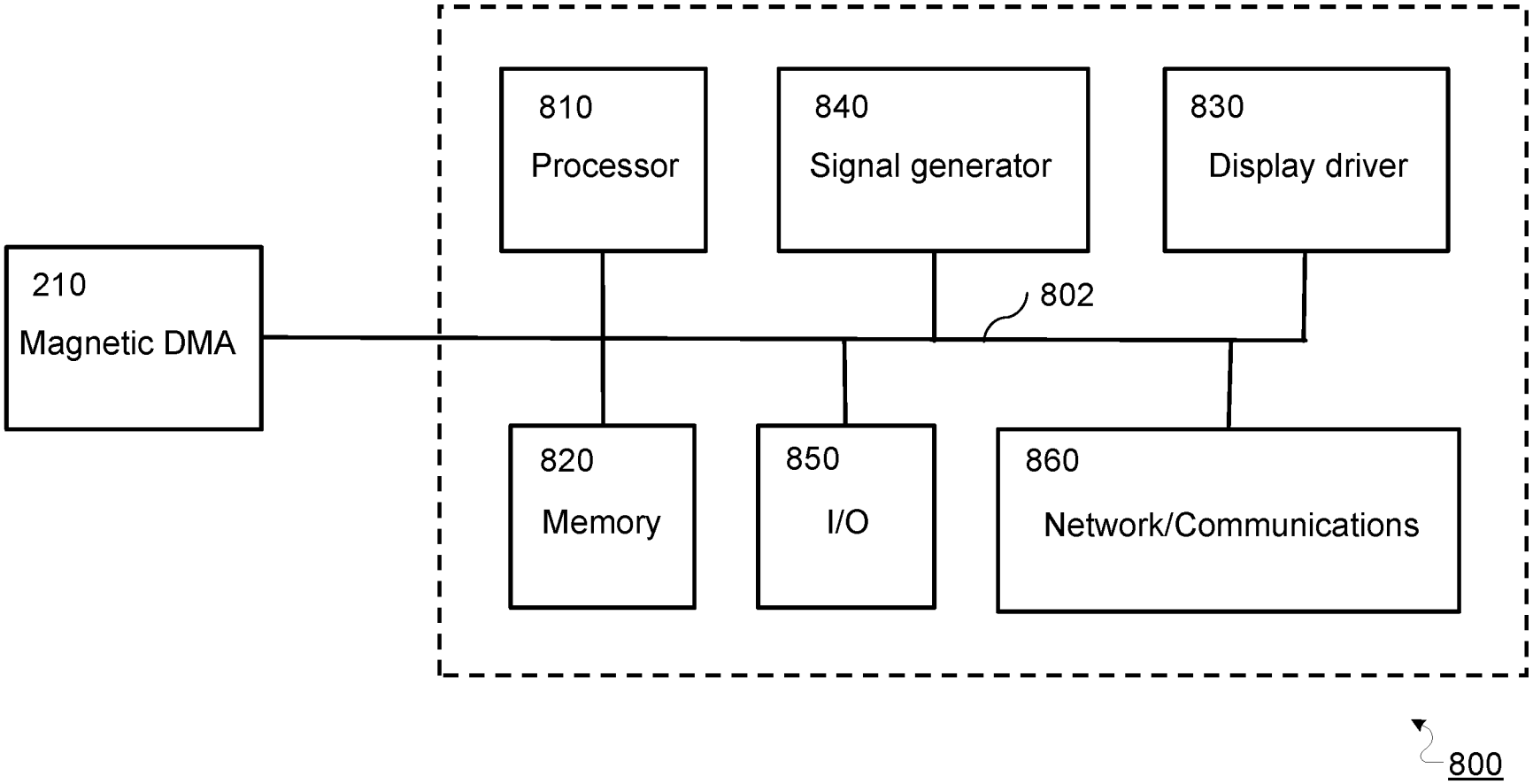
FIG. 8 is a schematic diagram of an embodiment of an electronic control module for a mobile device.

In general, the disclosed actuators are controlled by an electronic control module, e.g., electronic control module 220 in FIG. 2 above. In general, electronic control modules are composed of one or more electronic components that receive input from one or more sensors and/or signal receivers of the mobile phone, process the input, and generate and deliver signal waveforms that cause actuator 210 to provide a suitable haptic response. Referring to FIG. 8, an exemplary electronic control module 800 of a mobile device, such as mobile device 100, includes a processor 810, memory 820, a display driver 830, a signal generator 840, an input/output (I/O) module 850, and a network/communications module 860. These components are in electrical communication with one another (e.g., via a signal bus 802) and with actuator 210.

Processor 810 may be implemented as any electronic device capable of processing, receiving, or transmitting data or instructions. For example, processor 810 can be a microprocessor, a central processing unit (CPU), an application-specific integrated circuit (ASIC), a digital signal processor (DSP), or combinations of such devices.

Memory 820 has various instructions, computer programs or other data stored thereon. The instructions or computer programs may be configured to perform one or more of the operations or functions described with respect to the mobile device. For example, the instructions may be configured to control or coordinate the operation of the device's display via display driver 830, signal generator 840, one or more components of I/O module 850, one or more communication channels accessible via network/communications module 860, one or more sensors (e.g., biometric sensors, temperature sensors, accelerometers, optical sensors, barometric sensors, moisture sensors and so on), and/or actuator 210.

Signal generator 840 is configured to produce AC waveforms of varying amplitudes, frequency, and/or pulse profiles suitable for actuator 210 and producing acoustic and/or haptic responses via the actuator. Although depicted as a separate component, in some embodiments, signal generator 840 can be part of processor 810. In some embodiments, signal generator 840 can include an amplifier, e.g., as an integral or separate component thereof.

Memory 820 can store electronic data that can be used by the mobile device. For example, memory 820 can store electrical data or content such as, for example, audio and video files, documents and applications, device settings and user preferences, timing and control signals or data for the various modules, data structures or databases, and so on. Memory 820 may also store instructions for recreating the various types of waveforms that may be used by signal generator 840 to generate signals for actuator 210. Memory 820 may be any type of memory such as, for example, random access memory, read-only memory, Flash memory, removable memory, or other types of storage elements, or combinations of such devices.

As briefly discussed above, electronic control module 800 may include various input and output components represented in FIG. 8 as I/O module 850. Although the components of I/O module 850 are represented as a single item in FIG. 8, the mobile device may include a number of different input components, including buttons, microphones, switches, and dials for accepting user input. In some embodiments, the components of I/O module 850 may include one or more touch sensor and/or force sensors. For example, the mobile device's display may include one or more touch sensors and/or one or more force sensors that enable a user to provide input to the mobile device.

Each of the components of I/O module 850 may include specialized circuitry for generating signals or data. In some cases, the components may produce or provide feedback for application-specific input that corresponds to a prompt or user interface object presented on the display.

As noted above, network/communications module 860 includes one or more communication channels. These communication channels can include one or more wireless interfaces that provide communications between processor 810 and an external device or other electronic device. In general, the communication channels may be configured to transmit and receive data and/or signals that may be interpreted by instructions executed on processor 810. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 860 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the mobile device 100 to a mobile phone for output on that device and vice versa. Similarly, the network/communications module 860 may be configured to receive input provided on another device to control the mobile device. For example, an audible alert, visual notification, or haptic alert (or instructions therefor) may be transmitted from the external device to the mobile device for presentation.

The actuator technology disclosed herein can be used in panel audio systems, e.g., designed to provide acoustic and/or haptic feedback. The panel may be a display system, for example based on OLED of LCD technology. The panel may be part of a smartphone, tablet computer, or wearable devices (e.g., smartwatch or head-mounted device, such as smart glasses).

Other embodiments are in the following claims.

What is claimed is:

1. A panel audio loudspeaker, comprising:

a panel extending in a plane and having a panel surface;

an actuator coupled to the panel and configured to couple vibrations to the panel to cause the panel to emit audio waves, the actuator comprising:

a rigid frame attached to the panel surface, the rigid frame comprising a portion extending perpendicular to the panel surface and a plate extending parallel to the panel;

a magnet assembly and a magnetic coil forming a magnetic circuit;

at least one flexible member connecting the magnetic circuit to the portion of the rigid frame extending perpendicular to the panel surface; and a compliant layer extending parallel to the panel and having a surface in contact with the plate, the compliant layer being positioned between the magnetic circuit and the panel, the compliant layer being configured to increase output of the panel audio loudspeaker for at least some frequencies from 5 kHz to 20 kHz compared to the actuator without the compliant layer.

2. The panel audio loudspeaker of claim 1, wherein the compliant layer is positioned between the magnetic circuit and the plate.

3. The panel audio loudspeaker of claim 2, wherein the compliant layer is positioned between the magnetic coil and the plate, the compliant layer mechanically coupling the magnetic coil to the plate.

4. The panel audio loudspeaker of claim 1, wherein the compliant layer is positioned between the panel and the plate.

5. The panel audio loudspeaker of claim 4, wherein the compliant layer is substantially coextensive with the panel.

6. The panel audio loudspeaker of claim 1, wherein the response of the panel audio loudspeaker is at least 5 dB higher for at least some frequencies from 7.5 kHz to 20 kHz compared to the actuator without the compliant layer.

7. The panel audio loudspeaker of claim 1, wherein the compliant layer comprises a foam.

8. The panel audio loudspeaker of claim 1, wherein the compliant layer comprises an elastomer.

9. The panel audio loudspeaker of claim 1, wherein the compliant layer comprises a pressure sensitive adhesive.

10. The panel audio loudspeaker of claim 1, wherein the compliant layer comprises a material having a Shore A hardness in a range from 20 to 90.

11. The panel audio loudspeaker of claim 1, wherein the magnetic coil is rigidly attached to the plate.

12. The panel audio loudspeaker of claim 1, wherein the panel comprises a display panel.

13. A mobile device, comprising:

an electronic display panel extending in a plane and having an electronic display panel surface;

a chassis attached to the electronic display panel and defining a first space between a back panel of the chassis and the electronic display panel;

an electronic control module housed in the first space, the electronic control module comprising a processor;

a back plate facing the electronic display panel, the electronic display panel and the back plate defining a second space therebetween; and an actuator housed in the second space and attached to the electronic display panel surface, the actuator and electronic display panel forming a panel audio loudspeaker, wherein the actuator comprises:

a rigid frame attached to the electronic display panel surface, the rigid frame comprising a portion extending perpendicular to the electronic display panel surface and a plate extending parallel to the electronic display panel;

a magnet assembly and a magnetic coil forming a magnetic circuit;

at least one flexible member connecting the magnetic circuit to the portion of the rigid frame extending perpendicular to the electronic display panel surface; and a compliant layer extending parallel to the panel and having a surface in contact with the plate, the compliant layer being positioned between the magnetic circuit and the electronic display panel, the compliant layer being configured to increase output of the panel audio loudspeaker for at least some frequencies from 5 kHz to 20 kHz compared to the actuator without the compliant layer;

wherein the electronic control module is in electrical communication with the actuator and programmed to activate the actuator during operation of the mobile device to cause vibration of the electronic display panel.

14. The mobile device of claim 13, wherein the mobile device is a mobile phone or a tablet computer.

15. A wearable device comprising:

an electronic display panel extending in a plane and having a panel surface;

a chassis attached to the electronic display panel and defining a first space between a back panel of the chassis and the electronic display panel;

an electronic control module housed in the first space, the electronic control module comprising a processor;

a back plate facing the electronic display panel, the electronic display panel and the back plate defining a second space therebetween; and an actuator housed in the second space and attached to the electronic display panel surface, the actuator and electronic display panel forming a panel audio loudspeaker, wherein the actuator comprises:

a rigid frame attached to the electronic display panel surface, the rigid frame comprising a portion extending perpendicular to the electronic display panel surface and a plate extending parallel to the electronic display panel;

a magnet assembly and a magnetic coil forming a magnetic circuit;

at least one flexible member connecting the magnetic circuit to the portion of the rigid frame extending perpendicular to the electronic display panel surface; and a compliant layer extending parallel to the panel and having a surface in contact with the plate, the compliant layer being positioned between the magnetic circuit and the electronic display panel, the compliant layer being configured to increase output of the panel audio loudspeaker for at least some frequencies from 5 kHz to 20 kHz compared to the actuator without the compliant layer;

wherein the electronic control module is in electrical communication with the actuator and programmed to activate the actuator during operation of the wearable device to cause vibration of the electronic display panel.

16. The wearable device of claim 15, wherein the wearable device is a smart watch or a head-mounted display.

17. The panel audio loudspeaker of claim 1, wherein the compliant layer is substantially coextensive in the plane with the magnetic coil.

18. The panel audio loudspeaker of claim 1, wherein the compliant layer is substantially coextensive in the plane with the plate.

19. The panel audio loudspeaker of claim 1, wherein the surface of the compliant layer in contact with the plate comprises a first surface, the compliant layer having a second surface opposite the first surface, wherein the second surface is in contact with the panel surface.

* * * * *